United States Patent [19]

Knodt

[11] Patent Number: 5,049,931

[45] Date of Patent: Sep. 17, 1991

[54] REPRODUCTION MACHINE HAVING A JOB RUN DISPLAY SCREEN WITH GRAPHIC SYMBOL

[75] Inventor: Ruediger W. Knodt, Rochester, N.Y.

[73] Assignee: Xerox Corporation, Stamford, Conn.

[21] Appl. No.: 569,898

[22] Filed: Aug. 20, 1991

[51] Int. Cl.[5] ..... G03G 21/00

[52] U.S. Cl. ..... 355/209; 355/204; 355/313

[58] Field of Search ..... 364/188, 189; 355/200, 355/204, 209, 313, 206; 340/712, 716, 721, 723

[56] References Cited

U.S. PATENT DOCUMENTS

| | | | |
|---|---|---|---|
| 4,521,847 | 6/1985 | Ziehm et al. | 364/184 |
| 4,559,519 | 12/1985 | Matsumoto et al. | 355/209 X |
| 4,619,514 | 10/1986 | Ide | 355/209 |
| 4,633,432 | 12/1990 | Kitamura | 364/900 |
| 4,682,158 | 7/1987 | Ito et al. | 364/189 X |
| 4,870,459 | 9/1989 | Ito et al. | 355/204 X |
| 4,896,223 | 1/1990 | Todome | 340/712 X |
| 4,920,337 | 4/1990 | Kuo | 340/712 X |

OTHER PUBLICATIONS

Canon's Operator's Manual NP-4835s, 1989.

*Primary Examiner*—Joan H. Pendegrass
*Assistant Examiner*—Robert Beatty
*Attorney, Agent, or Firm*—Ronald F. Chapuran

[57] ABSTRACT

The present invention is the method and apparatus for operator-machine dialogue and for providing operator prompts and selectable features for programming the operation of the machine including the steps of providing a graphic symbol, the graphic symbol having an operator action required mode and an operator no-action required mode displaying the operator reaction required mode of the graphic suymbol to initiate operator dialogue with the machine and operator commencement of a job run having a plurality of job features, responding to the operator commencement of a job run to display the operator no-action required mode of the graphic symbol, and concurrently displaying an exhibit of valid job features that can be altered during the job run. The invention further includes the technique to selectively alter displays in accordance with the level of operator experience.

13 Claims, 13 Drawing Sheets

REPRODUCTION MACHINE HAVING A JOB RUN DISPLAY SCREEN WITH GRAPHIC SYMBOL

The invention relates to the machine/operator interface, and more particularly, to a system for facilitating the introduction of an operator to a touch screen display and establishing a natural dialogue between operator and machine.

As reproduction machines such as copiers and printers become more complex and versatile in operation, the user interface between the machine and the operator must necessarily be made as simple and effortless as possible if full and efficient utilization of the machine is to be realized. A suitable interface must not only provide the controls, displays, and messages necessary to activate, program, monitor, and maintain the machine, but must also provide a level of messages and operator prompts for a wide range of trained and untrained operators to accurately and efficiently program the machine for a complex reproduction run. A primary concern is the smooth transition of a novice operator into familiarity with a touch screen display and to avoid the distraction and alienation of a screen with an overwhelming exhibit of graphic displays and text messages.

Various prior art techniques are directed to operator messages and prompts as described below:

U.S. Pat. No. 4,322,814 to Menezes et al. discloses an error detection system for use in an editing apparatus. The system includes a central processing unit comprising an error detector responsive to the operation of a control switch to detect if data displayed in a selected display register is enabling for carrying out an editing operation. If the data is not enabling, the system inhibits the edit operation and actuates selected ones of indicators to notify an operator of an error condition.

U.S. Pat. No. 4,649,515 to Thompson et al. discloses a method and apparatus for fault diagnosis and control of a system. The system comprises two levels of rules including domain specific rules in the form of a list stored in a memory, and meta-level rules also stored in memory. The meta-level rules search a knowledge base and effectively construct a rule network to detect and report malfunctions, output control signals for modifying the operation of a monitored system, and aid users by providing information relative to malfunctions which pinpoints probable causes.

U.S. Pat. No. 4,682,158 to Ito et al. discloses a guidance device for controlling various functions of a machine. Sensors within a machine respond to various maintenance or diagnostic conditions. Signals from the sensors cause a storage means to supply corresponding prompts to a display to prompt a needed maintenance or diagnostic procedure. When an appropriate procedure has been performed, additional prompts for subsequent procedures are displayed if appropriate.

U.S. Pat. No. 4,438,326 to Uchida discloses a system for performing transactions wherein a customer may follow instructions comprising a procedure specifying message and a procedure specifying illustration. In a test mode selected by a clerk, a display unit shows an operation test code for a particular function button. When a trouble has been detected, the display unit shows the cause of the detected trouble and provides instructions for the clerk.

U.S. Pat. No. 4,792,827 to Ogura discloses a display device for use in an image forming apparatus including a condition detection member, a display section, and a first input key for causing a first message to be displayed on the display section. The first message represents guidance for operating the apparatus. Second and third input keys are further provided for causing second and third messages to be displayed representative of guidance for an operation procedure.

A difficulty with the prior art systems is that generally there is not a means to differentiate between trained and untrained, skilled or unskilled machine operators. It the machine messages and prompts are geared to an untrained level, a skilled operator will become impatient and maybe even confused by the slow, deliberate display of messages and prompts intended for an unskilled operator. At best the efficiency of the skilled operator will be comprised, and the deliberate style of displays could even lead to programming errors. On the other hand, a machine user interface geared to a skilled level of operator may be efficient for the skilled operator, but could easily result in confusion and delay for the unskilled operator. Another difficulty with prior art systems is often the inability of the operator to determine if the machine is expecting operator action at that particular stage of the machine/operator dialogue or the machine is still in the process of responding to an operator action. Pending application, U.S. Ser. No. 07/328,975, assigned to the same assignee as the present invention discloses a technique of automatically altering the messages for prompting the operator, depending upon the level of operator training, including the steps of programming the machine at a first level, recognizing the programming of the machine at the first level to represent either trained or untrained operator programming, responding to the recognition of either trained or untrained operator programming at the first level for providing either a trained sequence of operator prompts or an untrained sequence of operator prompts.

A difficulty with such a technique as described above is that the initial introduction to the machine is the same for novice and experienced operators. An experienced operator generally has little difficulty in understanding the screen displays and is able to efficiently program and operate from the beginning. For a novice operator, the likelihood of a lack of understanding and resultant programming errors is often very high, particularly with the first introduction to a touch screen display. Another difficulty is that the same displays are usually given for all levels of operator experience. Also, it is not often clear in what stage of the machine/operator dialogue the system is operating. In addition, there is no simple means to alter a job program during a job run. It would be desirable to provide a simple manifestation of the state of the machine/operator dialogue and to be able to adapt the displays to operator training level.

It is an object of the present invention, therefore, to provide a new and improved technique for introducing a novice operator to a touch screen display operator interface. It is another object of the present invention to provide a technique of displaying graphic symbols on a touch screen display to direct a first time user into an action mode and a no action mode on a touch screen control. It is a further object of the present invention to provide frames of graphic symbols introducing a human element suggested required action and for coaxing an operator into dialogue with the machine and to be able to selectively display or not display the frames. It is a further object of the invention to provide a means to concurrently display job features that can be altered during a job run. Further advantages of the present invention will become apparent as the following description proceeds and the features characterizing the invention will be pointed out with particularity in the claims annexed to and forming a part of this specification.

SUMMARY OF THE INVENTION

Briefly, the present inventioin is the metod and apparatus for operator-machine dialogue and for providing operator prompts and selectable features for programming the operation of the machine including the steps of providing a graphic symbol, the graphic symbol having an operator action required mode and an operator no-action required mode, displaying the operator action required mode of the graphic symbol to initiate operator dialogue with the machine and operator commencement of a job run having a plurality of job features, responding to the operator commencement of a job run to display the operator no-action required mode of the graphic symbol, and concurrently displaying an exhibit of valid job features that can be altered during the job run. The invention further includes the means to selectively alter displays in accordance with the level of operator experience.

For a better understanding of the present invention, reference maybe had to be accompanying drawings wherein the same reference numerals have been applied to like parts and wherein:

IN THE DRAWINGS

DETAILED DESCRIPTION OF THE INVENTION

Figure 1:
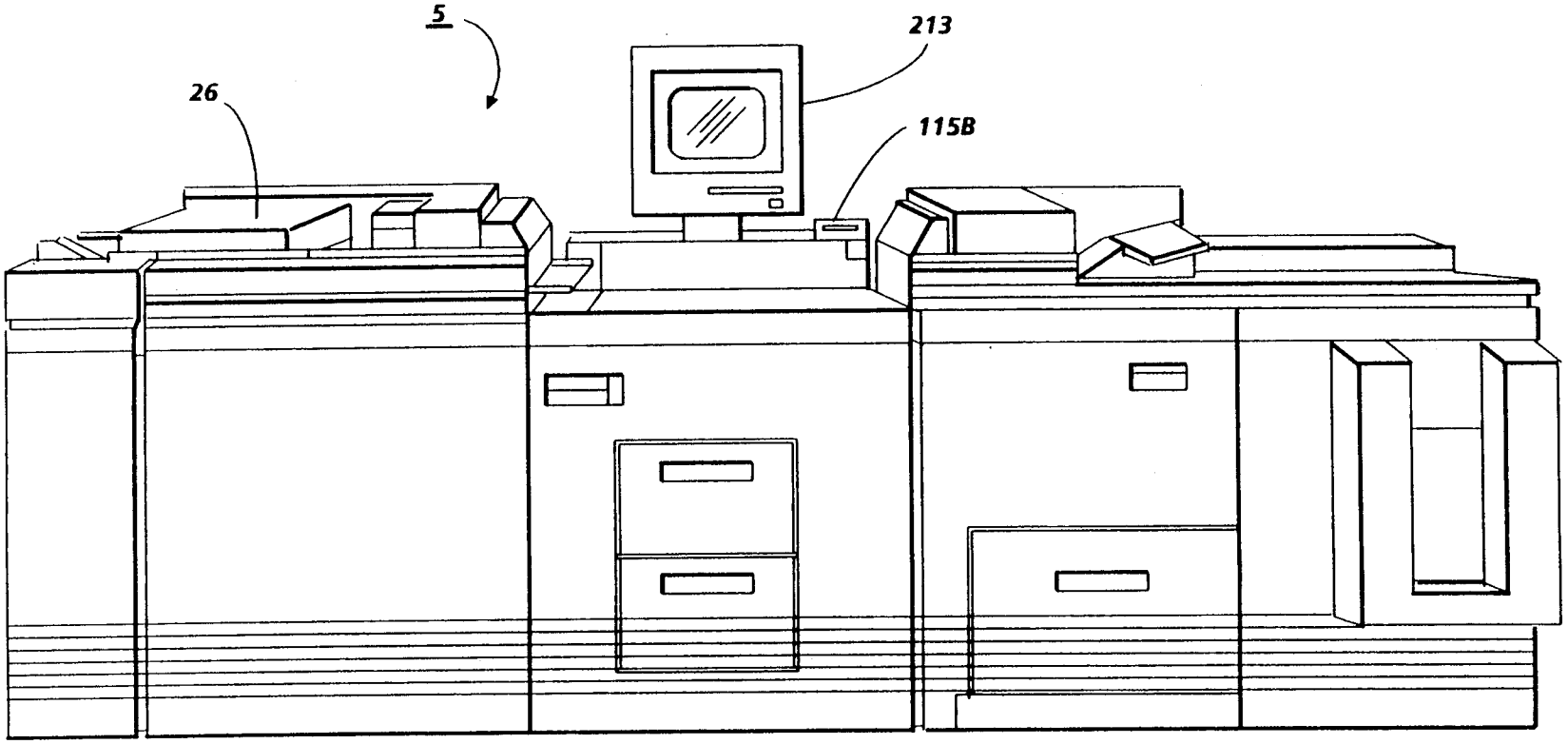
FIG. 1 is an isometric view of an illustrative reproduction machine incorporating the present invention.
Figure 2:
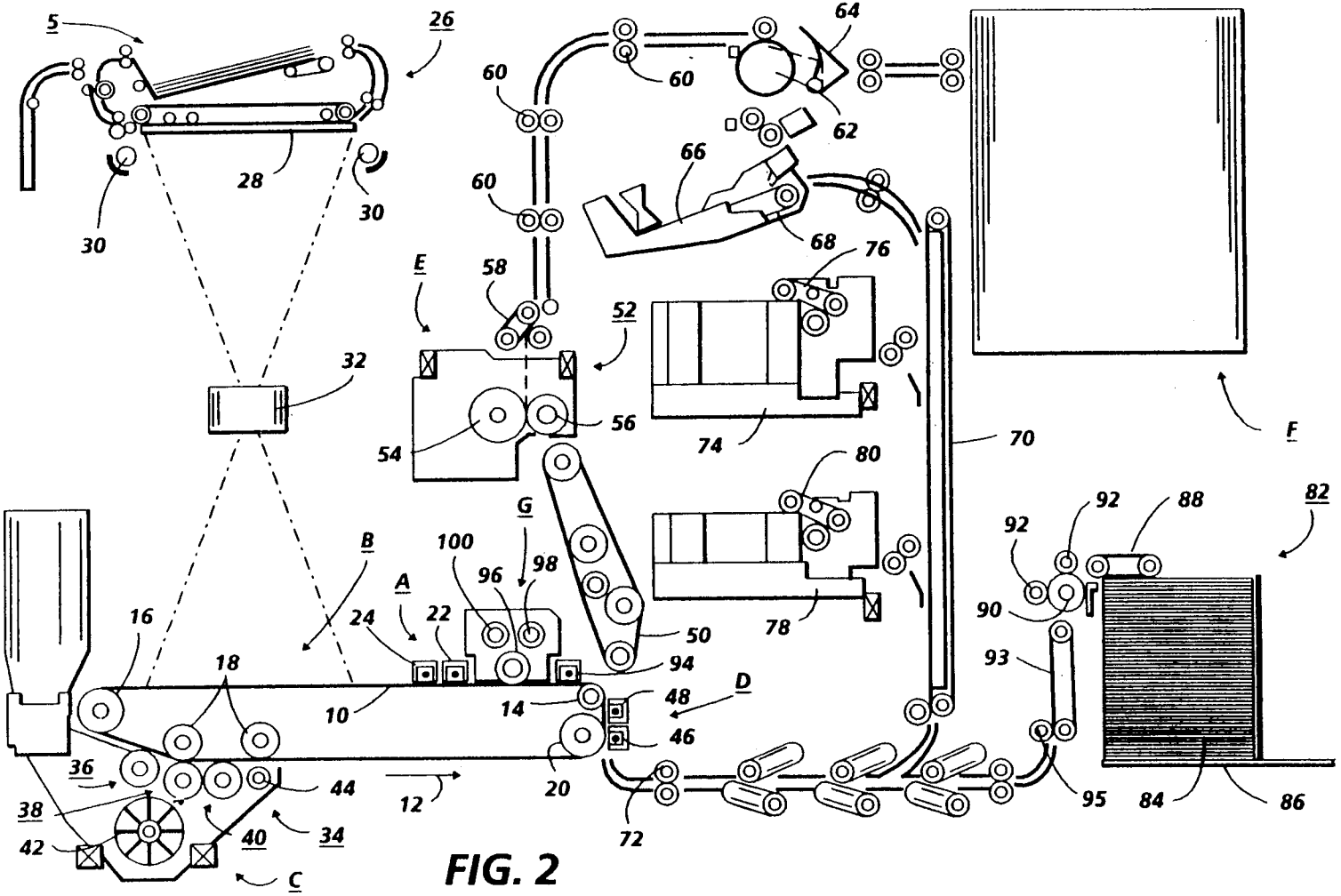
FIG. 2 is a schematic elevational view depicting various operating components and sub-systems of the machine shown in FIG. 1.

Referring to FIGS. 1 and 2, there is shown an electrophotographic reproduction machine 5 composed of a plurality of programmable components and sub-systems which cooperate to carry out the copying or printing job programmed through a touch dialogue User Interface (U.I.). Machine 5 is typical of the machine incorporating the present invention and employes a photoconductive belt 10. Belt 10 is entrained about stripping roller 14, tensioning roller 16, idler rollers 18, and drive roller 20. Drive roller 20 is rotated by a motor coupled thereto by suitable means such as a belt drive. As roller 20 rotates, it advances belt 10 in the direction of arrow 12 through the various processing stations disposed about the path of movement thereof.

Initially, the photoconductive surface of belt 10 passes through charging station A where two corona generating devices, indicated generally by the reference numerals 22 and 24 charge photoconductive belt 10 to a relatively high, substantially uniform potential. Next, the charged photoconductive belt is advanced through imaging station B. At imaging station B, a document handling unit 26 sequentially feeds documents from a stack of documents in a document stacking and holding tray into registered position on platen 28. A pair of Xenon flash lamps 30 mounted in the optics cavity illuminate the document on platen 28, the light rays reflected from the document being focused by lens 32 onto belt 10 to expose and record an electrostatic latent image on photoconductive belt 10 which corresponds to the informational areas contained within the document currently on platen 28. After imaging, the document is returned to the document tray via a simplex path when either a simplex copy or the first pass of a duplex copy is being made or via a duplex path when a duplex copy is being made.

The electrostatic latent image recorded on photoconductive belt 10 is developed at development station C by a magnetic brush developer unit 34 having three developer rolls 36, 38 and 40. A paddle wheel 42 picks up developer material and delivers it to the developer rolls 36; 38. Developer roll 40 is a cleanup roll while a magnetic roll 44 is provided to remove any carrier granules adhering to belt 10.

Following development, the developed image is transferred at transfer station D to a copy sheet. There, the photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detach the copy sheet from belt 10.

Following transfer, a conveyor 50 advances the copy sheet bearing the transferred image to fusing station E where a fuser assembly, indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Forwarding rollers 60 then advance the sheet via duplex turn roll 62 to gate 64 which guides the sheet to either finishing station F or to duplex tray 66, the latter providing an intermediate or buffer storage for those sheets that have been printed on one side and on which an image will be subsequently printed on the second, opposed side thereof. The sheets are stacked in duplex tray 66 face down on top of one another in the order in which they are copied.

To complete duplex copying, the simplex sheets in tray 66 are fed, in seriatim, by bottom feeder 68 back to transfer station D via conveyor 70 and rollers 72 for transfer of the second toner powder image to the opposed sides of the copy sheets. The duplex sheet is then fed through the same path as the simplex sheet to be advanced to finishing station F.

Copy sheets are supplied from a secondary tray 74 by sheet feeder 76 or from the auxiliary tray 78 by sheet feeder 80. Sheet feeders 76, 80 are friction retard feeders utilizing a feed belt and take-away rolls to advance successive copy sheets to transport 70 which advances the sheets to rolls 72 and then to transfer station D.

A high capacity feeder 82 is the primary source of copy sheets. Tray 84 of feeder 82, which is supported on an elevator 86 for up and down movement, has a vacuum feed belt 88 to feed successive uppermost sheets from the stack of sheets in tray 84 to a take away drive roll 90 and idler rolls 92. Rolls 90, 92 guide the sheet onto transport 93 which in cooperation with idler roll 95 and rolls 72 move the sheet to transfer station station D.

After transfer station D, photoconductive belt 10 passes beneath corona generating device 94 which charges any residual toner particles remaining on belt 10 to the proper polarity. Thereafter, a pre-charge erase lamp (not shown), located inside photoconductive belt 10, discharges the photoconductive belt in preparation for the next charging cycle. Residual particles are removed from belt 10 at cleaning station G by an electrically biased cleaner brush 96 and two de-toning rolls 98 and 100.

The various functions of machine 5 are regulated by a controller which prefeably comprises one or more programmable microprocessors. The controller provides a comparison count of the copy sheets, the number of documents being recirculated, the number of copy sheets selected by the operator, time delays, jam corrections, etc. As will appear, programming and operating control over machine 5 is accomplished through a User Interface. Operating and control information, job programming instructions, etc. are stored in a suitable memory which includes both ROM and RAM memory types. Conventional sheet path sensors or switches may be utilized to keep track of the position of the documents and the copy sheets. In addition, the controller regulates the various positions of the gates depending upon the mode of operation selected.

Figure 3:
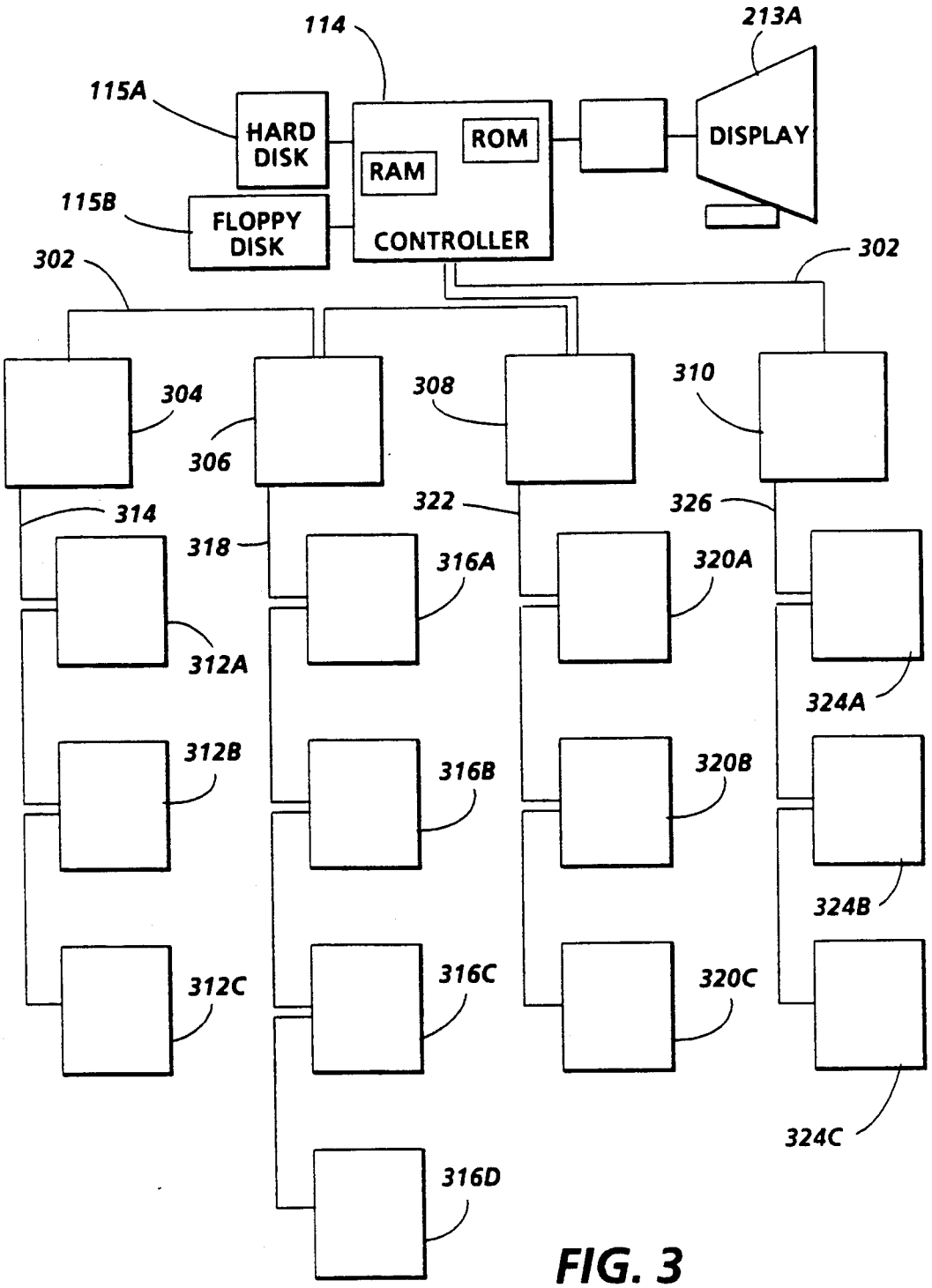
FIG. 3 is a block diagram of the operating control systems and memory for the machine shown in FIG. 1.

With reference to FIG. 3, memory 115 includes a hard or rigid disk drive 115A and a floppy disk drive 115B connected to Controller 114. In a preferred embodiment, the rigid disks are two platter, four head disks with a formatted storage capacity of approximately 20 megabytes. The floppy disks are 3.5 inch, dual sided micro disks with a formatted storage capacity of approximately 720 kilobytes. Preferably, all of the control code and screen display information for the machine is loaded from the rigid disk at machine power up. Changing the data that gets loaded into the machine for execution can be done by exchanging the rigid disk in the machine 5 for another rigid disk with a different version of data or by modifying the contents of the current rigid disk by transferring data from one or more floppy disks onto the rigid disk using the floppy disk drive built into the machine 5. Suitable display 213A of U.I. 213 is also connected to Controller 114 as well as a shared line system bus 302.

The shared line system bus 302 interconnects a plurality of core pritned wiring boards including an input station board 304, a marking imaging board 306, a paper handling board 308, and a finisher/binder board 310. Each of the core printed wiring boards is connected to local input/output devices through a local bus. For example, the input station board 304 is connected to digital input/output boards 312A and 312B and servo board 312C via local bus 314. The marking imaging board 306 is connected to analog/digital/analog boards 316A, 316B, digital input/output board 316C, and stepper control board 316D through local bus 318. In a similar manner, the paper handling board 308 connects digital input/output boards 320A, B and C to local bus 322, and finisher/binder board 310 connects digital input/output boards 324A, B and C to local bus 326.

Figure 4:
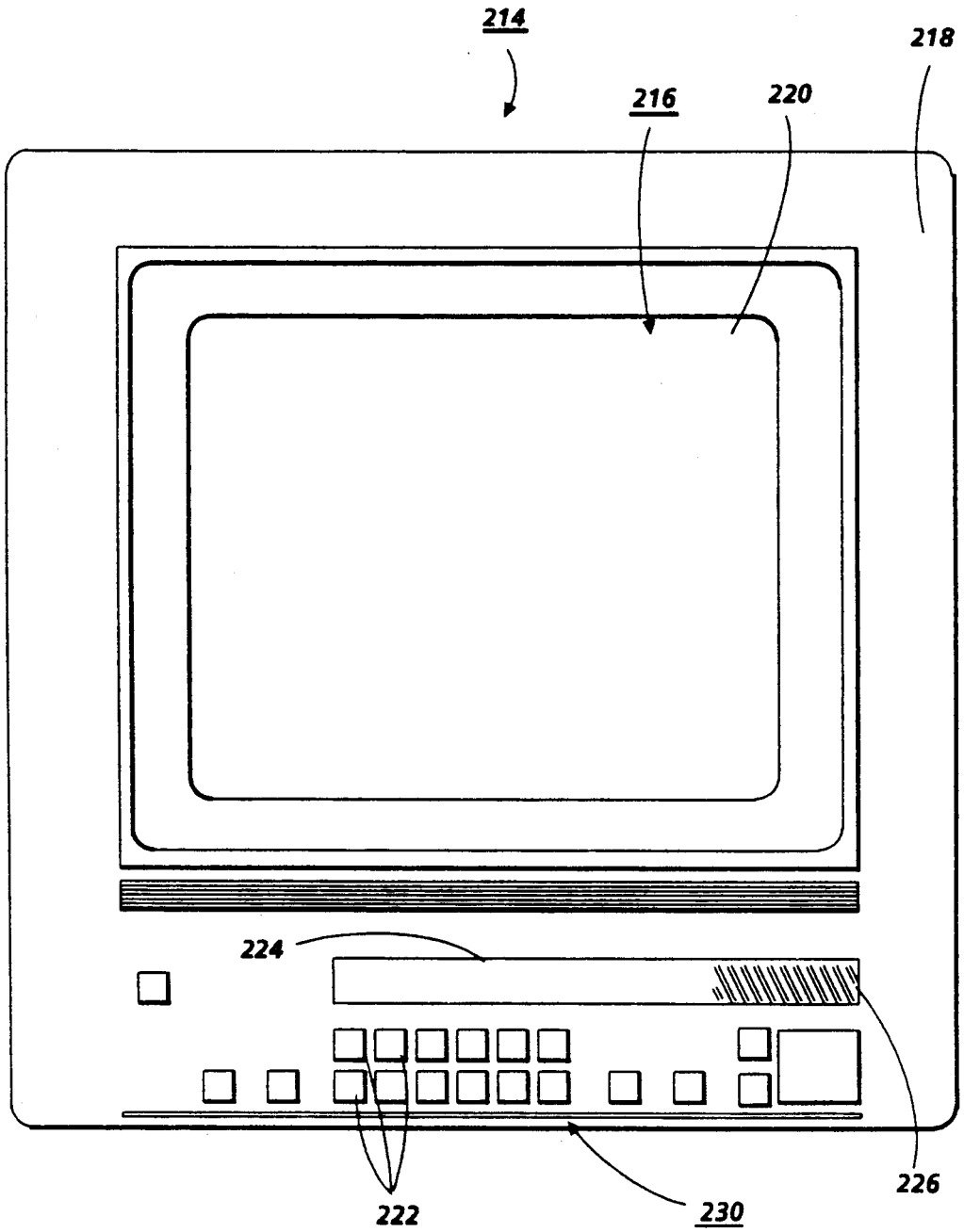
FIG. 4 is a front view of the of the user interface of the machine of FIG. 1.

Referring to FIG. 4, there is shown the color touch monitor 214 for the touch dialogue user interface. As will appear, monitor 214 provides an operator user interface with hard and soft touch control buttons enabling communication between operator and machine 10. Monitor 214 comprises a suitable color cathode ray tube 216 of desired size and type having a peripheral framework forming a decorative bezel 218 thereabout. Bezel 218 frames a rectangular video display screen 220 on which soft touch buttons in the form of icons or pictograms and messages are displayed as will appear together with a series of hard control buttons 222 and 10 seven segment displays 224 therebelow. Displays 224 provide a display for copy "Quantity Selected", copy "Quantity Completed", and an area 226 for other information.

Hard control buttons 222 comprise "0–9" buttons providing a keypad 230 for programming copy quantity, code numbers, etc.; a clear button "C" to reset display 224; a "Start" button to initiate print; a clear memory button "CM" to reset all dialogue mode features to default and place a "1" in the least significant digit of display 224; an "Unload Stacker" button requesting transfer of the contents of a stacker; a "Stop" button to initiate an orderly shutdown of machine 5; a "Binder Warm-up" button to initiate warm-up of a binder; an "Interrupt" button to initiate a job interrupt; a "Proof" button to initiate making of a proof copy; an "End Job" button to end the current job; and an "i" button to initiate a request for information.

Operator programming of the machine via the U/I is facilitated through display of programming screens on the CRT display which represent programming features of the machine. Signals from an IR touch sensor are fed to the machine controller where they are interpreted with respect to the current programming screen. Subsequently operator selections are displayed on the CRT display and the appropriate machine subsystems are enabled, disabled or adjusted accordingly.

Figure 5:
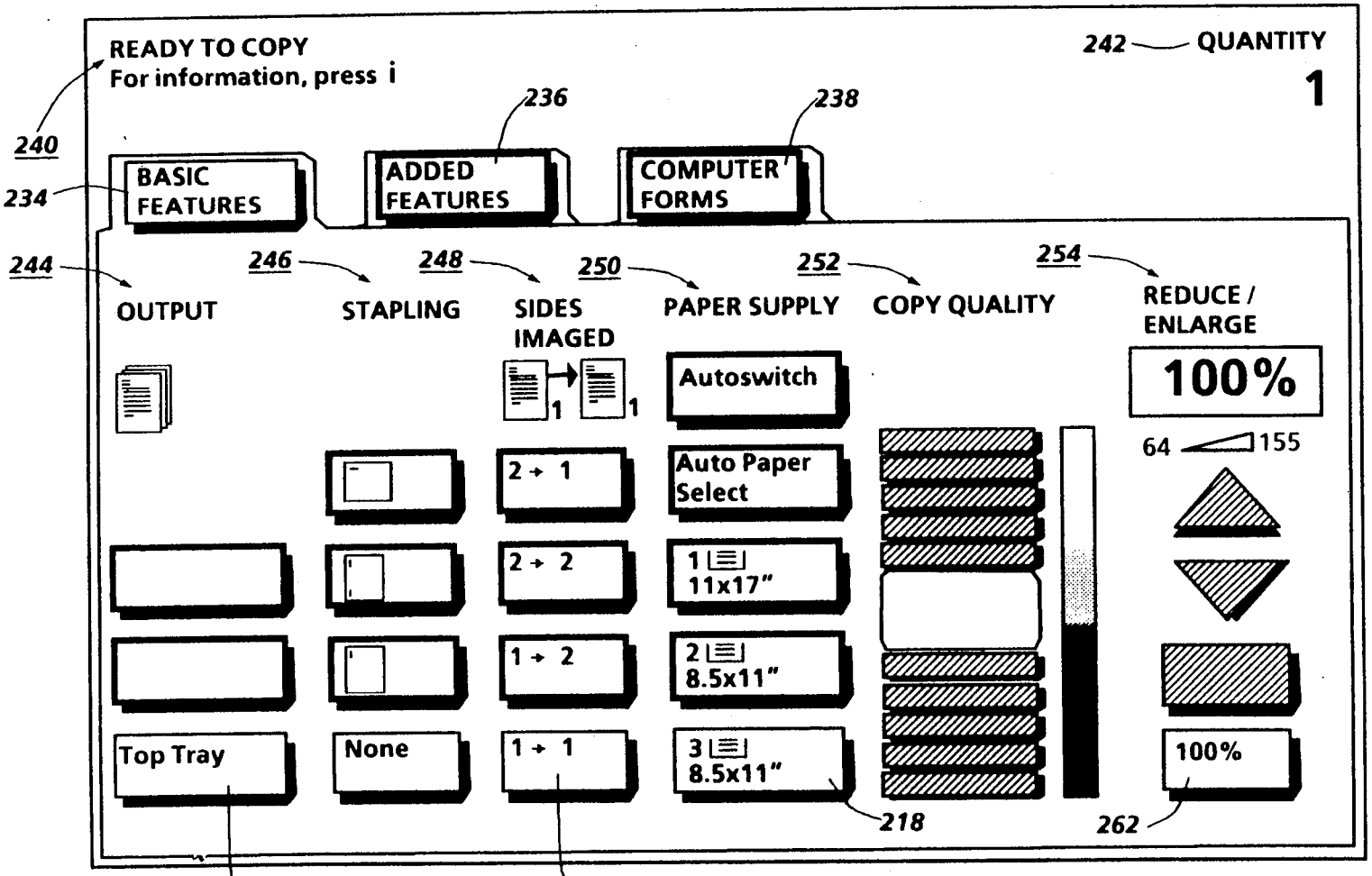
FIG. 5 is a typical initial touch screen display for operator-machine dialogue of the machine of FIG. 1.

Programming screens, as displayed on the CRT display, are used by the operator to select the feature set appropriate for the completion of a copying job. Specifically, the programming screens consist of a series of three primary screens, arranged in a file folder or tab format, as illustrated in FIG. 5. In certain instances, selection of specific programming features can only be done to the exclusion of other features due to machine constraints or known undesirable outcomes (i.e. stapling of transparency copy sheets). The currently programmed feature set is always displayed using programming screens, where selected features are indicated as highlighted or white buttons and disabled or deselected features are indicated with a gray background.

With reference to FIG. 5, there is illustrated a typical user interface display or screen providing an operator/machine dialogue. The screen presents to the operator in the form of tabs, a basic features mode 234, an added features mode 236, and a computer forms mode 238. Also at the top of the display frame are a machine ready indicator 240 and a quantity programmed indicator 242. The three modes typically could be in a gray appearance and upon selection of a particular mode such as the top tray 256 by the operator, the top tray soft button would transform from a gray appearance to a white appearance. There are also illustrated basic programming features available to the operator other than the quantity or number of copies to be produced, such a a copy output feature 244, a stapling feature 246, copy sides feature 248, a paper supply feature 250, a copy quality feature 252 and a reduction and enlarge feature 254. These features display to the operator a variety of options available to program the machine. For example, the copy output feature can offer the operator an uncollated mode, a collated mode, or simply a single sheet top tray mode illustrated at 256.

Similarly, various other "soft" buttons are available for the operator to select a particular stapling feature 246 format for the stapling of completed sets or various combinations of simplex or duplex copying, a one-to-one simplex mode 258 being illustrated in FIG. 5 as the option selected by the operator or the paper supply feature 250 from which copy sheets are desired to be provided from. Similarly there are options to determine copy quality such as lighter or darker and reduction and enlargement from 64% to 155%, FIG. 5 illustrating a particular copy quality selection and also a reduction-/enlargement selection 262 of 100%.

With reference to FIG. 4 the hard control buttons such as at 222 are in a familiar format or style to even a novice machine or display user because of the keyboard-like setting. On the other hand, many machine users and operators are often not accustomed to touching or jabbing a CRT screen to initiate programming operations. In fact, such a display as illustrated in FIG. 5 can often be confusing to an operator. Even if the operator or user is familiar with the copier options such as copy output, paper supply, copy quality, and reduction and enlargement, where and how to begin the selection process can be a source of a perplexity. It is often difficult to determine if operator input is required or if the machine is processing operator input. A novice operator confronted with a display as illustrated in FIG. 5 can easily become confused and waste valuable time in ultimately understanding the machine/operator interface including the manner and sequence of operator/-machine dialogue.

Figure 6:
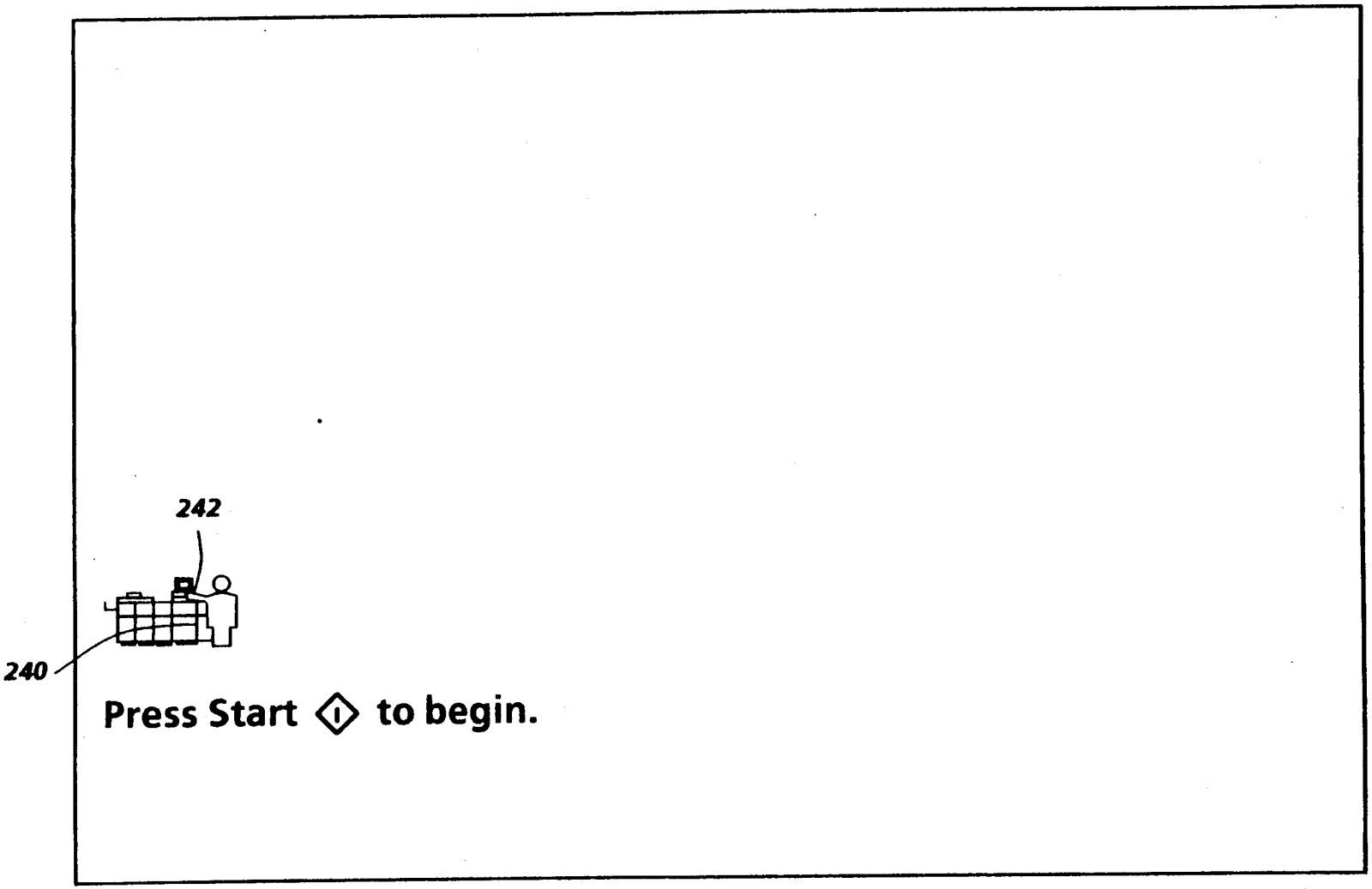
FIGS. 6 and 7 are the initial touch screen displays for operator machine dialogue of the machine of FIG. 1 in accordance with the present invention.
Figure 8:
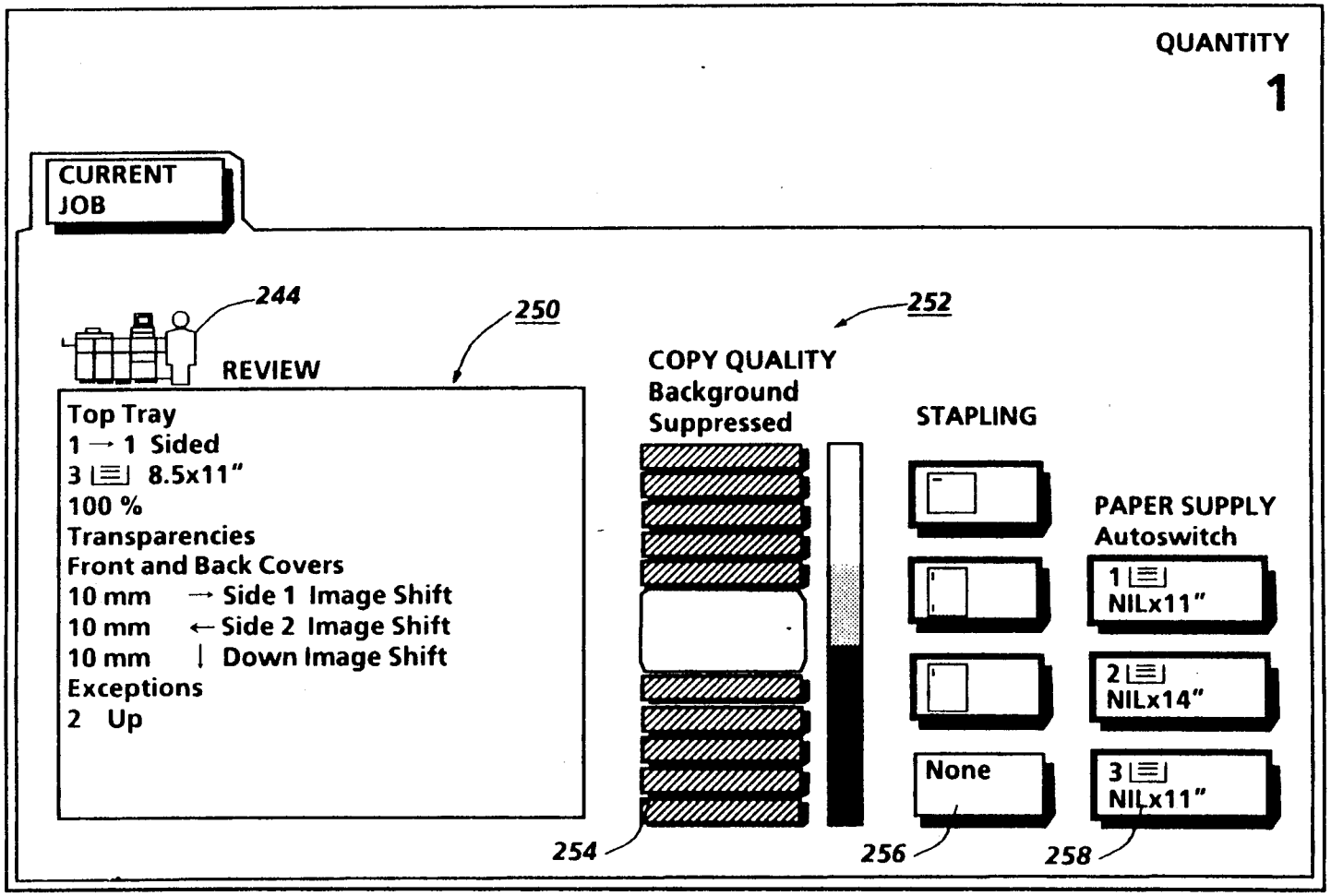
FIG. 8 is a screen display of features available for change during a job run in accordance with the present invention.

In accordance with the present invention, a typical first display screen, as illustrated in FIG. 5, is replaced with an initial display screen as illustrated in FIG. 6. The display screen of FIG. 6 with the figure with raised arm and the text "Press Start * to begin" has the impact or effect upon the novice operator of conveying the concept of an operator action in the machine/operator dialogue. In particular, the display provides a graphic symbol 240, having an operator action required mode symbol 242 (raised arm) and an operator no-action required position 244 (lowered arm) as seen in FIG. 8. The operator action required mode symbol 242 displays and conveys to the operator the need for operator action in the operator/machine dialogue. The operator no-action required position 244 is displayed in response to the operator commencement of operator dialogue with the machine to display the operator no-action required mode, indicating that the machine is taking appropriate action or that no action is required. In other words, the initiation of operator dialogue with the machine and displaying the operator no-action position include the steps of raising and lowering an abstract depiction of an arm on the screen display.

Figure 7:
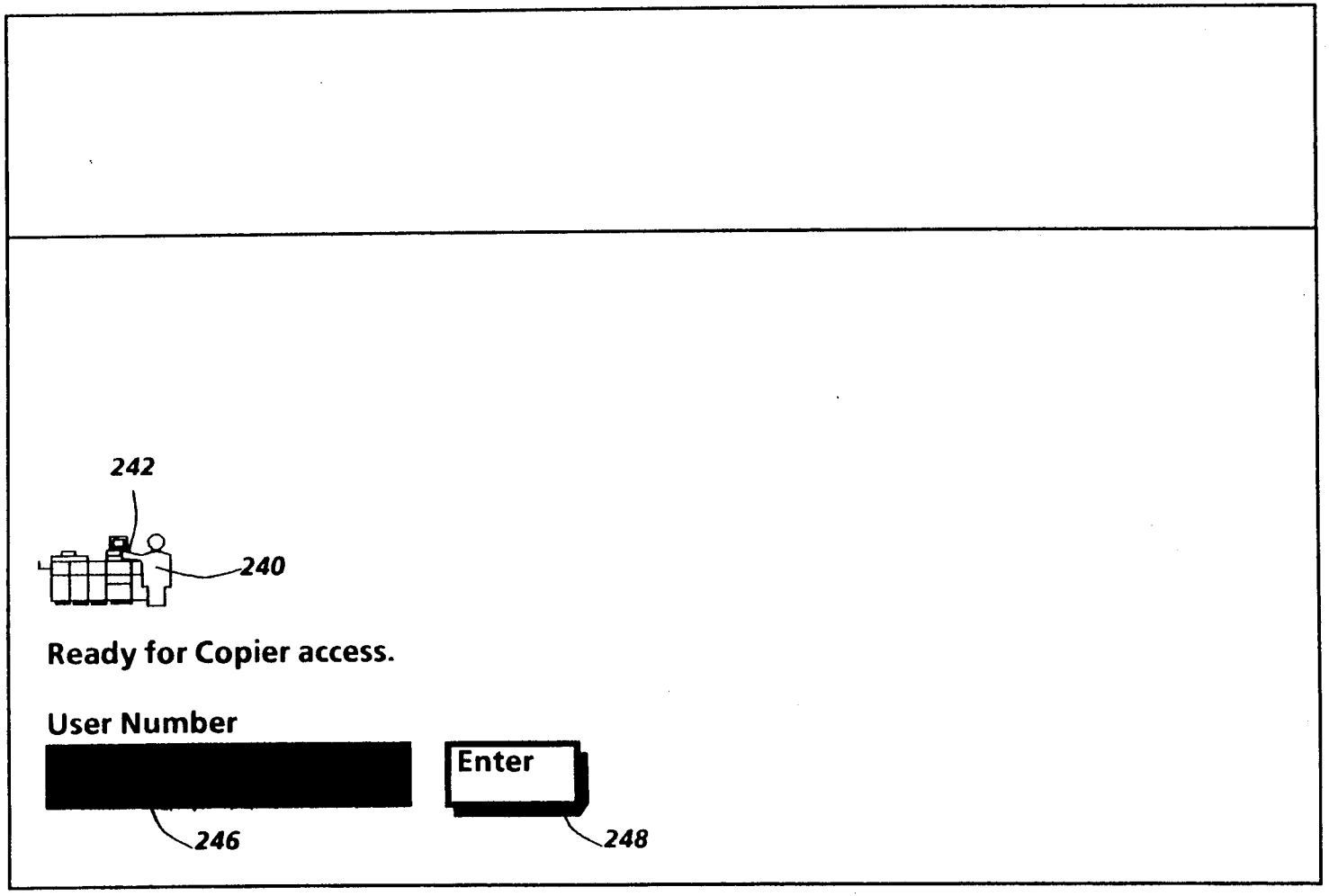

FIG. 7 is another illustration of the figure with raised arm and the text "Ready for copier access" that conveys to an operator action in the machine/operator dialogue. Again, the graphic symbol 240, has an operator action required mode symbol 242 (raised arm) to convey to the operator the need for operator action. Similar to FIG. 6, a first symbol provides the meaning of a request for action and the follow up version of the symbol provides the meaning that the request has been satisfied. The scenario is generally as follows. The operator pushes buttons or targets to make known to the machine its requests. The machine in response, presents menus, pictorials, written statements, and audio sounds to convey meaning. For restricted access, a User; Number display 246 and enter button 248 are also provided.

The machine is unaware of the presence of any users, thus requests potential users to push a button or enter a code number on the control panel to signal the presence of a user. This request for action is conveyed via the icon, an extended hand or arm with a supportive message signifying action. The user complies and describes the desired job to the machine (programs the machine) by pressing buttons. The machine starts the job and confirms to the users the task parameters 250 on a RUN screen, as shown in FIG. 8. The machine then indicates via the icon 240 with an inactive lowered arm 244 the the machine is performing the work, freeing the user from any further work until the job is completed.

With further reference to FIG. 8, in accordance with the present invention, there is displayed at 252 job features that can be altered during a machine job run. Altering a job in progress by selecting a feature in conflict with the current job not only may be time wasting, but can possibly cause machine conflicts. To prevent an operator from attempting to alter a job in progress by selecting a feature in conflict with the current job, there is provided a display 252 of those features that can be altered during a job run without interrupting or conflicting with the job in progress. For example, in the job run features as displayed at 250, the operator can make changes as shown at 252 without conflicting with the job in progress. That is, the operator can alter copy quality 254, the stapling operation 256, or the paper supply 258. Obviously, with different job runs, the features that can be changed will vary.

Figure 9:
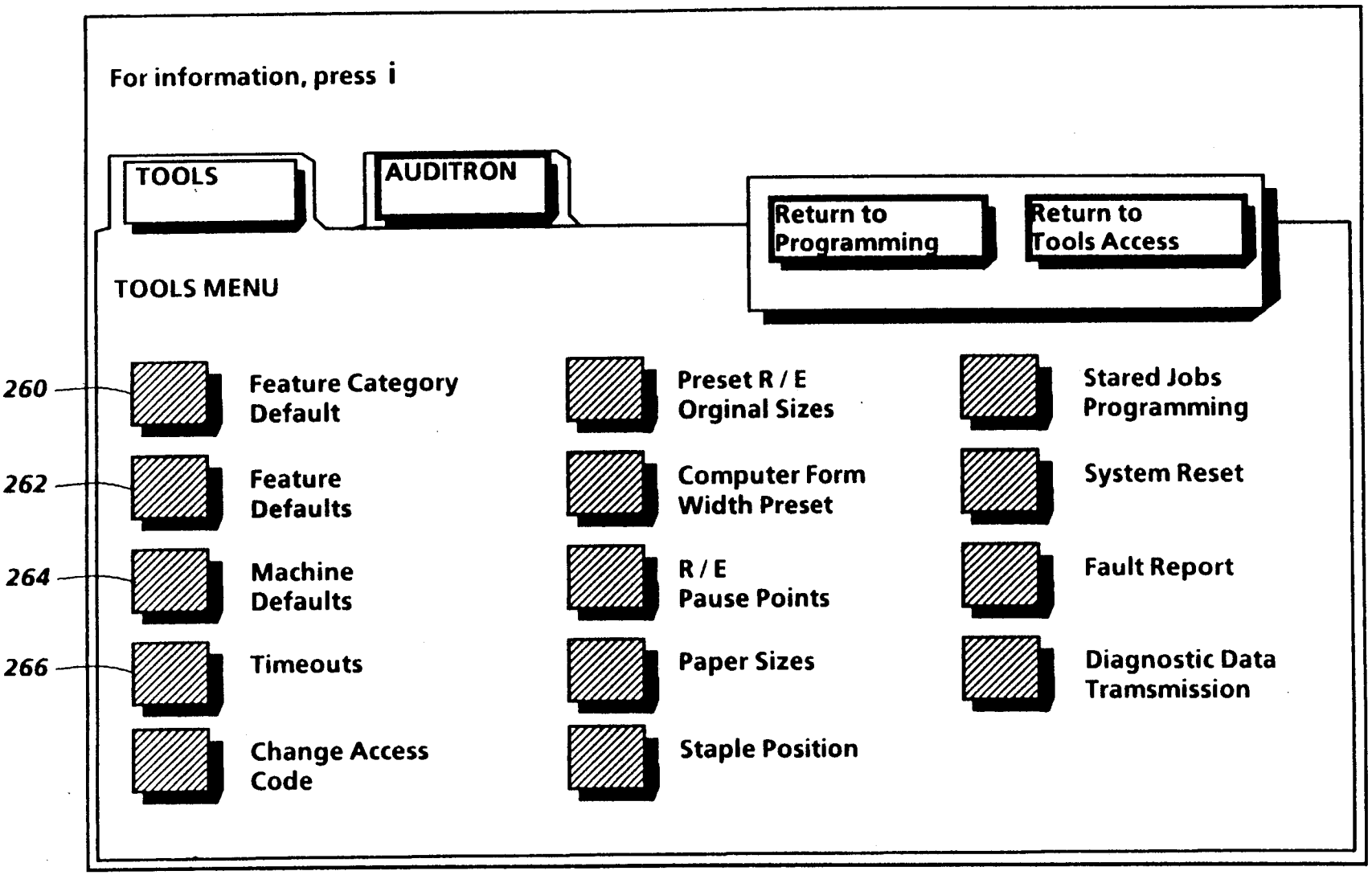
FIG. 9 illustrates the tools menu display in accordance with the present invention.
Figure 10:
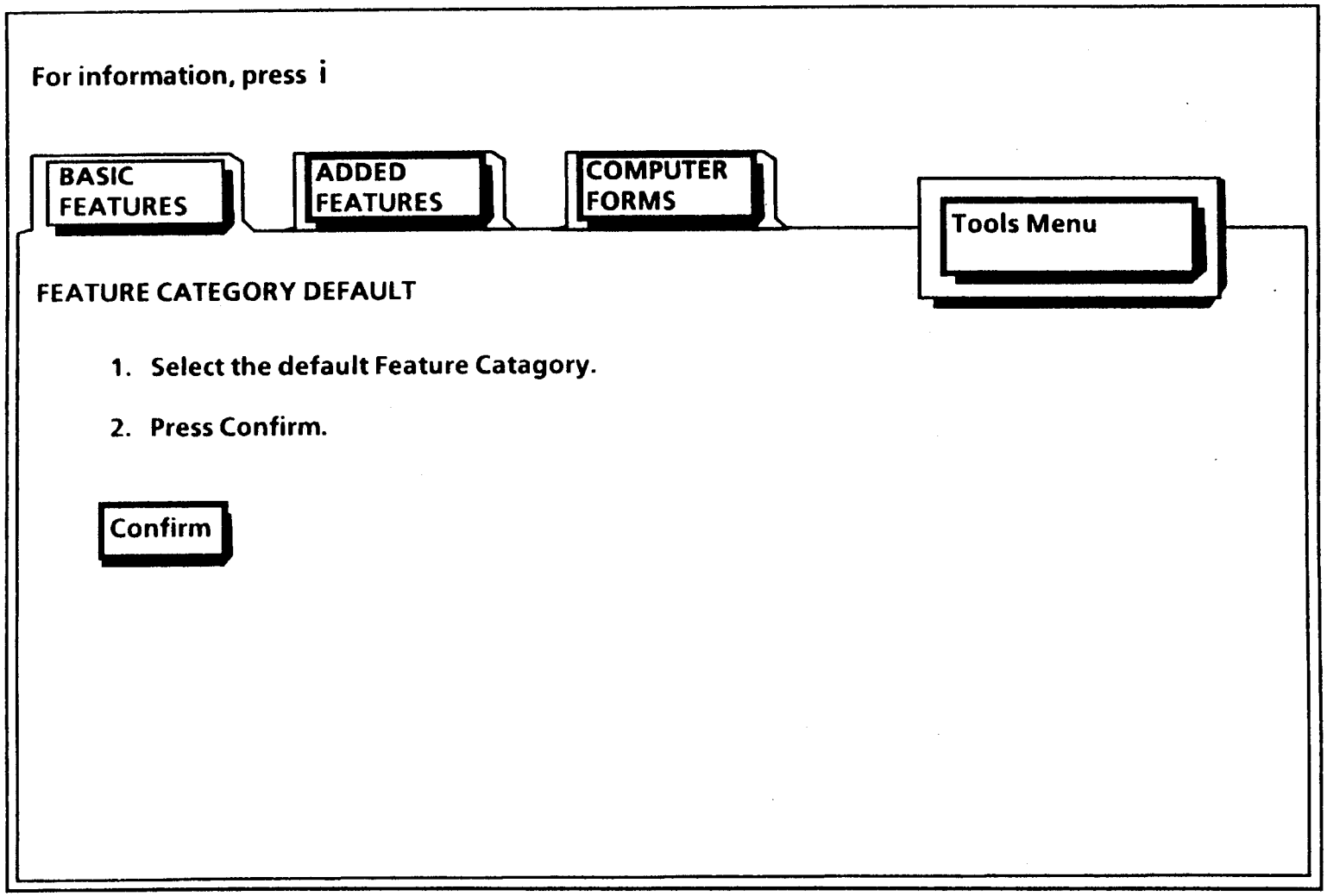
FIGS. 10, 11, 12 and 13 illustrate default programming displays in accordance with the present invention.

In accordance with the present invention, there is provided a Tools feature available only by entering a valid user number. Any suitable code entry procedures and validation techniques can be used for access. The screen display of FIG. 9 shows the Tools menu itemizing various restricted features such as Feature Category Default 260, Features Default 262, Machine Defaults 264, and Timeouts 266. Activation of the Feature Category default 260 results in a display as illustrated in FIG. 10. It should be understood the a default setting is the feature that a machine automatically returns to after cycle out or shut down. For example, a machine normally cycles up for simplex operation, but this feature, the default feature, could be changed to duplex operation every time the machine was cycled up.

Figure 11:
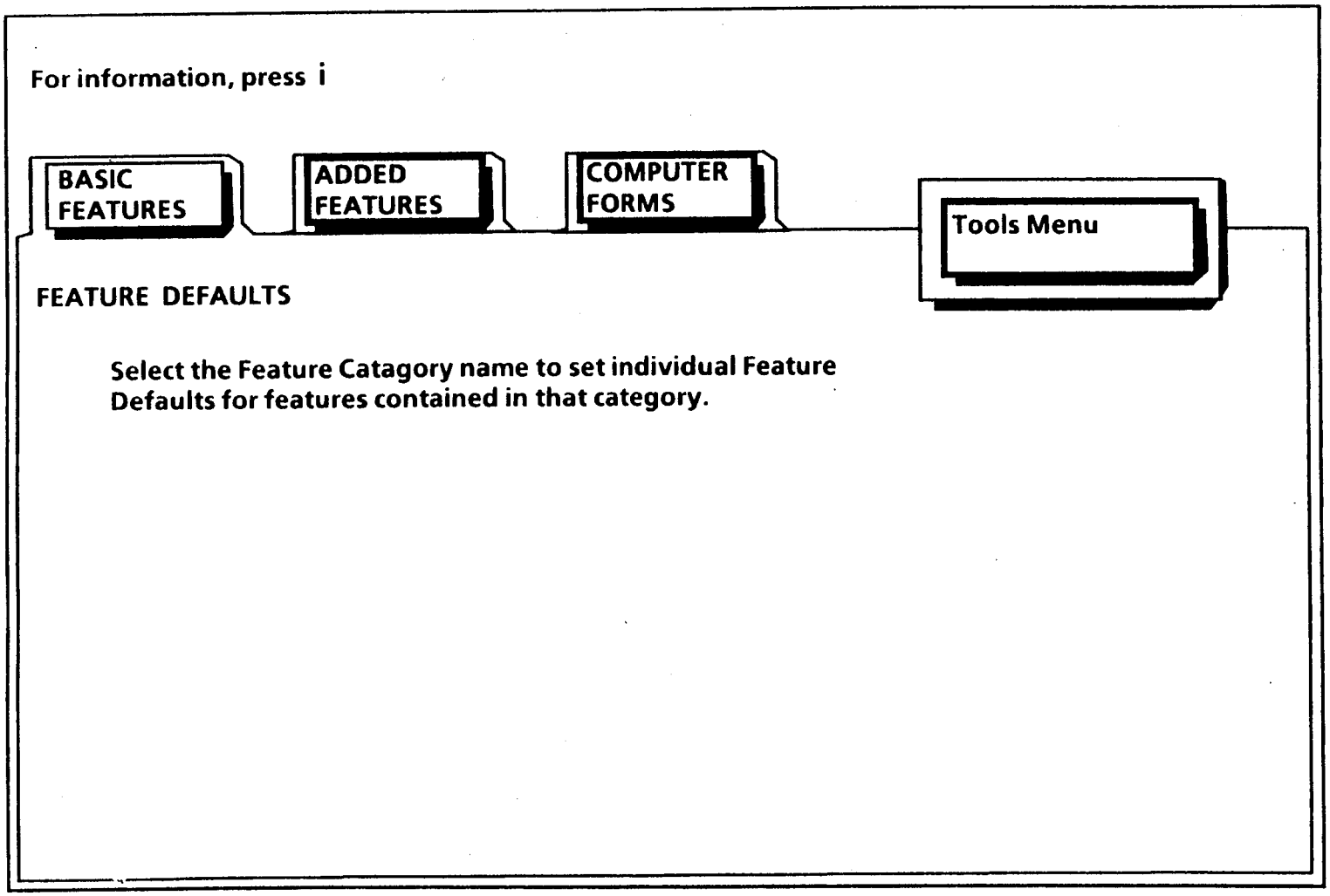
Figure 12:
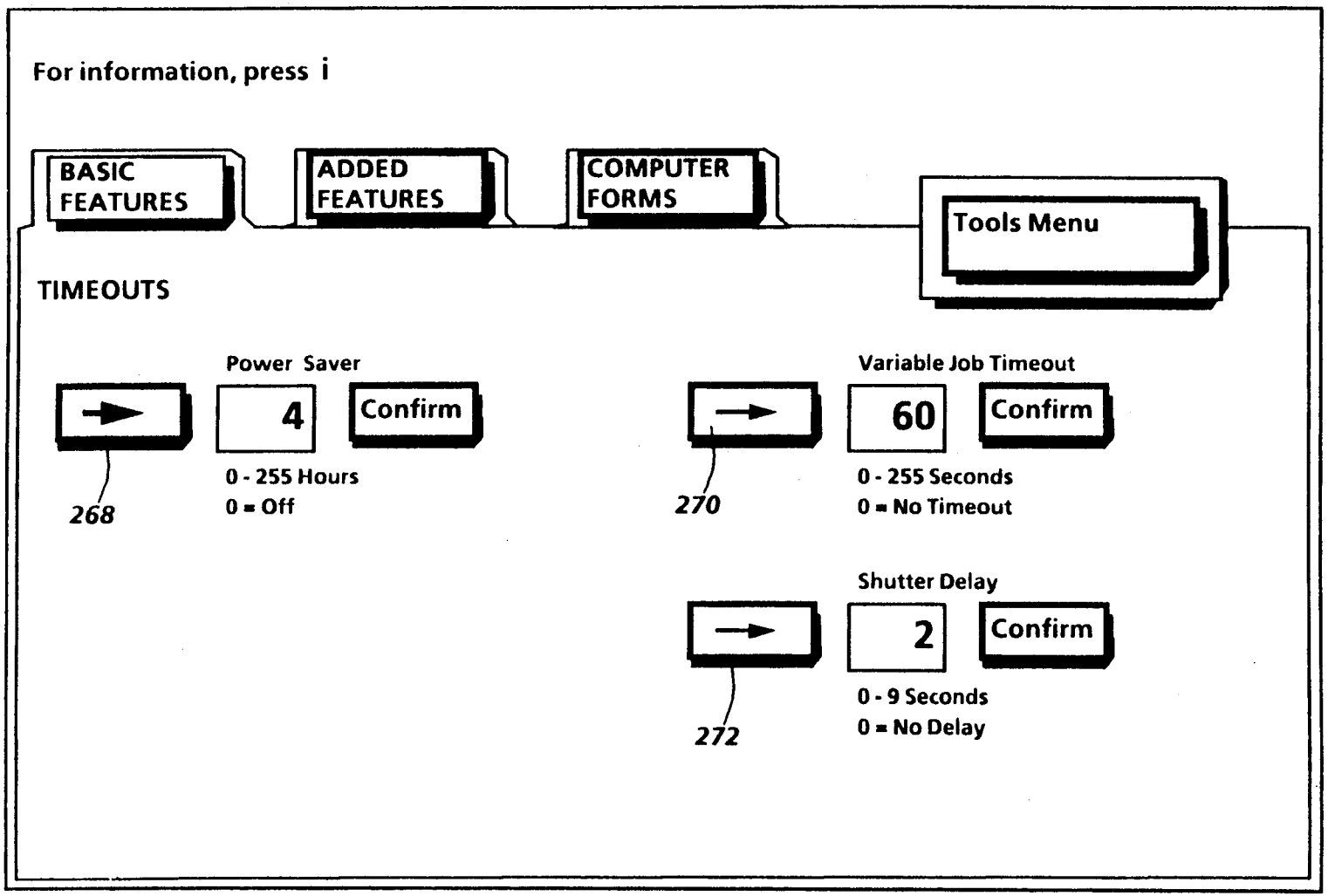

By selecting one of the three feature categories displayed on the menu, Basic Features, Added Features, and Compute Forms, the selection will specify which of the three programming screen will be selected for default display. Feature Defaults 262 allows the reprogramming of individual features such as copy Output or Stapling within the tree feature category screens. For example, as illustrated in FIG. 11, the operator selects the Feature Category that contains the feature default the operator desires to change. The operator then selects the new default setting in the same manner as routinely programming a job. The Timeouts 266 default feature allows the alteration of time periods of the machine, such as return to the default screen. This is accomplished as shown in FIG. 12 by merely touching the appropriate arrow for such features as Power Saver, 268, Variable Job Timeout 270, and Shutter Delay 272.

Figure 13:
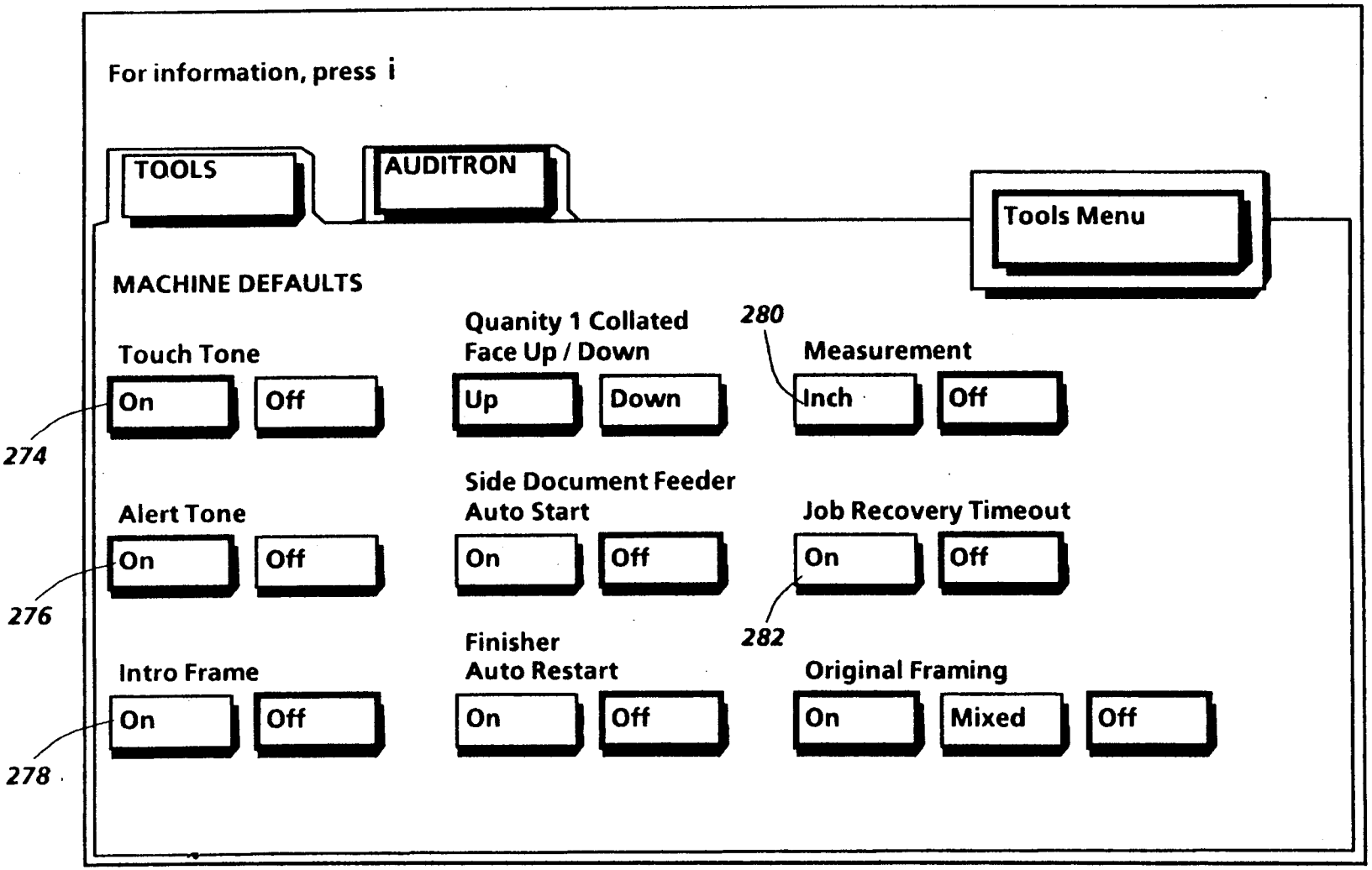

With reference to FIG. 13, Machine Defaults permits a key operator to customize such features as Touch Tone 274, Alert Tone 276, Intro Frame 278, Measurement 280, that is inches or metric, and Job Recovery Timeout 282. In particular, by entering Machine Defaults, the key operator can turn on or off the introduction frames depending upon the level of skill of the machine operators. The screen display of FIG. 6 is an example of an introduction frame that may not be necessary for skilled operators. It is then possible to tailor the screens or frames of the control to the skill and experience level of the operators. By selectively eliminating certain frames, the trained operator can be spared the display time of some frames that are, however, necessary to the untrained operator. This can be accomplished only by a key operator with access to the Machine Defaults menu through the Tools procedure.

It should also be noted that there are various means to convey information to an operator other than messages. Operator prompts or the conveyance of information to the operator could be done by highlighting icons, showing flow charts or trees, and relatively more or less detail of diagnostic fault frames. For example, assume covers are allowed only in collated jobs in a given machine. If the machine were in the untrained operator mode and the operator selected covers, the collated section on the output screen at the operator console could be highlighted or blinked. In essence, the highlighted section would inform the operator that the collated mode was the correct mode.

Icons could also be displayed in a color code. For example, a specific icon or image display could be green for a collated mode and red for an uncollated mode, conveying the information that selecting uncollated would create a conflict. Also, pictorial representations, such as flow charts or trees, displayed when a specific selection is made could illustrate for the operator the specific route or sequence of programming steps ahead and identify options. Fault frames typically display for operator's specific machine zones to clear. For an untrained operator, more detail of the fault zones could be shown.

While the invention has been described with reference to the structure disclosed, it is not confined to the details set forth, but is intended to cover such modifications or changes as may come within the scope of the following claims.

I claim:

1. In a reproduction machine having a control and user interface with a touch screen display for providing operator prompts and selectable features for programming the operation of the machine, the method of operator-machine dialogue comprising the steps of:

providing a graphic symbol, the graphic symbol having an operator action required mode and an operator no-action required mode, displaying the operator action required mode of the graphic symbol to initiate operator dialogue with the machine and operator commencement of a job run having a plurality of job features, responding to the operator commencement of a job run to display the operator no-action required mode of the graphic symbol, and concurrently displaying an exhibit of the plurality of job features and displaying an exhibit of valid job features that can be altered during the job run.

2. The method of claim 1 including the step of changing a job feature during the job run for the job run in progress.

3. The method of claim 1 wherein the graphic symbol is an icon depicting an abstract likeness of a human being and including the step of selectively altering the icon to provide the operator action required mode and the operator no-action required mode.

4. The method of claim 3 wherein the step of selectively altering the icon to provide the operator action required mode and the operator no-action required mode includes the steps of raising and lowering an abstract depiction of an arm on the screen display.

5. In a reproduction machine having a control and user interface with a touch screen display for providing operator prompts and selectable features for programming the operation of the machine, the method of operator-machine dialogue comprising the steps of:

providing a graphic symbol, the graphic symbol having an operator action required mode and an operator no-action required mode, the graphic symbol being an icon depicting an abstract likeness of a human being, displaying the operator action required mode of the graphic symbol to initiate operator dialogue with the machine, and responding to the operator commencement of operator dialogue with the machine to display the operator no-action required mode of the graphic symbol, the steps of displaying the operator action required mode of the graphic symbol to initiate operator dialogue with the machine and displaying the operator no-action required mode of the graphic symbol including the steps of raising and lowering an abstract depiction of an arm on the screen display.

6. The method of claim 5 including the steps of programming the machine for a job run, the job run including a plurality of job features, responding to the operator commencement of a job run, and concurrently displaying an exhibit of the plurality of job features and displaying an exhibit of valid job features that can be altered during the job run.

7. The method of claim 6 including the step of changing a job feature during the job run.

8. A reproduction machine having a control and user interface with a touch screen display for providing operator prompts and selectable features for programming the operation of the machine comprising:

means for providing a graphic symbol on the display, the graphic symbol having an operator action required mode and an operator no-action required mode, means for displaying the operator action required mode of the graphic symbol to initiate operator dialogue with the machine, means to commence a job run having a plurality of job features, means responsive to the operator commencement of a job run to display the operator no-action required mode of the graphic symbol, and means for concurrently displaying an exhibit of the plurality of job features and displaying an exhibit of valid job features that can be altered during the job run.

9. The machine of claim 8 including the means for selectively altering the graphic symbol to provide the operator action required mode and the operator no-action required mode, includes the steps of raising and lowering an abstract depiction of an arm on the screen display.

10. The machine of claim 8 including the step of providing an operation wherein the operator can selectively add or delete selected displays independent of the job run.

11. The machine of claim 8 including the step of selectively omitting the display of the operator action required mode and the operator no-action required mode.

12. A reproduction machine having a control and user interface with a touch screen display for programming the operation of the machine to coordinate a plurality of operating components to produce reproductions of images on support material, means for coaxing an operator into dialogue with the machine by means of the interface comprising:

means to exhibit a first frame on the touch screen display of the user interface to initiate machine operation, means for providing on the first frame a graphic symbol having an operator action required mode and an operator no-action required mode, means for displaying the operator action required mode of the graphic symbol to initiate operator dialogue with the machine and operator commencement of a job run having a plurality of job features, and means responding to the operator commencement of a job run to display the operator no-action required mode of the graphic symbol.

13. The machine of claim 12 including the means for selectively eliminating the first frame from display on the screen.

* * * * *

UNITED STATES PATENT AND TRADEMARK OFFICE

CERTIFICATE OF CORRECTION

PATENT NO. : 5,049,931

DATED : 09/17/91

INVENTOR(S) : Ruediger W. Knodt

It is certified that error appears in the above-identified patent and that said Letters Patent is hereby corrected as shown below:

On the title page, the correct filing date of Patent No. 5,049,931 is August 20, 1990. The issued U.S. Patent incorrectly shows an August 20, 1991 filing date.

Signed and Sealed this

Twentieth Day of April, 1993

*Attest:*

*Attesting Officer*

MICHAEL K. KIRK

*Acting Commissioner of Patents and Trademarks*